United States Patent [19]

Chin et al.

[11] Patent Number: 4,659,458

[45] Date of Patent: Apr. 21, 1987

[54] APPARATUS AND METHOD FOR FROTH FLOTATION EMPLOYING ROTATABLY MOUNTED SPRAYING AND SKIMMING MEANS

[75] Inventors: Ti-Hua Chin, Voorhees; Robert F. Turner, Jr., Turnersville, both of N.J.

[73] Assignee: The Standard Oil Company, Cleveland, Ohio

[21] Appl. No.: 810,865

[22] Filed: Dec. 19, 1985

[51] Int. Cl.[4] ..... B03D 1/02; B03D 1/14

[52] U.S. Cl. ..... 209/164; 209/168; 210/221.1; 210/241; 210/703; 210/776

[58] Field of Search ..... 209/168, 169, 170, 164; 210/221.2, 221.1, 241, 209, 525, 528, 703, 776, 720

[56] References Cited

U.S. PATENT DOCUMENTS

| | | | |
|---|---|---|---|
| 838,626 | 12/1906 | Kirby | 209/168 |
| 1,134,690 | 4/1915 | MacDonald | 209/170 |
| 1,297,372 | 3/1919 | Loventhal et al. . | |
| 1,557,369 | 11/1923 | Kleinbentink . | |
| 2,168,208 | 8/1939 | Jenks | 210/528 |
| 2,311,527 | 2/1943 | Frantz et al. | 209/168 |
| 2,804,341 | 8/1957 | Bete | 239/501 |
| 2,922,521 | 1/1960 | Schranz | 209/163 |
| 3,452,869 | 7/1969 | O'Neill | 210/520 |
| 3,864,257 | 2/1975 | Shaffer | 210/525 X |
| 4,022,696 | 5/1977 | Krofta | 210/221.2 |
| 4,304,573 | 12/1981 | Burgess et al. | 44/51 |
| 4,332,593 | 6/1982 | Burgess et al. | 44/51 |
| 4,347,126 | 8/1982 | McGarry et al. | 209/168 X |
| 4,347,127 | 8/1982 | Duttera et al. | 209/168 X |
| 4,412,843 | 11/1983 | Burgess et al. | 44/51 |
| 4,462,909 | 7/1984 | Kennel | 210/525 |
| 4,514,291 | 4/1985 | McGarry et al. | 209/170 X |

FOREIGN PATENT DOCUMENTS

| | | | |
|---|---|---|---|
| 552896 | 2/1958 | Canada | 210/525 |
| 121991 | 6/1948 | Sweden | 209/168 |
| 599847 | 3/1978 | U.S.S.R. | 209/168 |
| 980845 | 1/1981 | U.S.S.R. | 209/168 |

*Primary Examiner*—S. Leon Bashore
*Assistant Examiner*—Thomas M. Lithgow
*Attorney, Agent, or Firm*—Bruce E. Harang; Larry W. Evans; David J. Untener

[57] ABSTRACT

An apparatus for froth flotation separation of the components of a slurry, said apparatus comprising at least one flotation cell, at least one spray nozzle for feeding slurry to said flotation cell, and a rotatably mounted skimmer means for skimming froth from said flotation cell, wherein said spray nozzle is affixed to and situated behind the rotational direction of said skimmer means and wherein said spray nozzle and skimmer are adapted to simultaneously rotate thereby causing the skimmer to skim the froth in the direction opposite to the spraying direction of the spray nozzle.

10 Claims, 4 Drawing Figures

APPARATUS AND METHOD FOR FROTH FLOTATION EMPLOYING ROTATABLY MOUNTED SPRAYING AND SKIMMING MEANS

BACKGROUND OF THE INVENTION

This invention relates to an apparatus for froth flotation and more particularly to an improved means for generating and skimming froth in a froth flotation cell.

In froth flotation, an aqueous pulp of a comminuted mineral aggregate is subjected to aeration or the like in the presence of one or more flotation reagents with the result that a mineral-bearing froth is formed on top of the pulp. In order to provide efficient removal and collection of the froth, it is necessary to skim the froth from the surface of the liquid in the flotation tank.

Many froth flotation systems have been developed in order to improve froth generation as well as froth collection. For example, U.S. Pat. No. 1,557,369 discloses a froth flotation apparatus employing stationary and rotary spirally curved skimming elements for skimming off froth in an attempt to remove the froth without deteriorating it.

U.S. Pat. No. 2,311,527 discloses a froth flotation cell having a flotation chamber and a skimming means in the form of a helical blade rotatably mounted on a horizontal axis. It is stated that the helical paddle skimmer removes the froth from the top of the pulp much more efficiently than the flat paddle type. Other U.S. patents which disclose skimmer devices include U.S. Pat. Nos. 4,462,909, 3,864,257, 2,922,521 and 838,626.

Particularly suitable froth flotation apparatus especially useful for the beneficiation of coal are disclosed in U.S. Pat. No. 4,347,126 and U.S. Pat. No. 4,347,127. These patents disclose flotation apparatus wherein primary spray nozzles are positioned above the flotation tank for spraying input slurry and recycle spray nozzles are positioned above the tank for respraying particulate matter collected in collection troughs positioned in the tank for collecting sinking material. The spraying operation creates a froth on the water surface in the flotation tank in which a substantial quantity of particulate matter is floating. The froth is then skimmed from the water surface, e.g. by a skimming arrangement in which an endless conveyor belt carries a plurality of spaced skimmer plates depending therefrom.

While many froth flotation apparatus and skimming arrangements are known, improved flotation cells and skimming arrangements which are more efficient and which will still provide adequate beneficiation results are still desired.

SUMMARY OF THE INVENTION

Accordingly, it is one object of the present invention to provide an improved method and apparatus for froth flotation separation of a slurry of particulate matter.

Another object of this invention is to provide an improved froth flotation apparatus and method to generate a froth of particulate material such as carbonaceous particles, noncarbonaceous particles or mixtures thereof, coal particles, mine tailing, oil shale, residuals, waste particulates, mineral dressings, graphite, mineral ores, fines and the like.

A still further object of the present invention is to provide an improved apparatus and method for generating froth and skimming the generated froth from the liquid surface in a froth flotation cell.

Still another object of this invention is to provide an improved method and apparatus for froth flotation beneficiation of minerals, particularly coal, which are more efficient than prior art methods and apparatus and further which provide suitably beneficiated products and excellent recovery.

These and other objects are accomplished herein by providing an apparatus for froth flotation separation of the components of a slurry, said apparatus comprising:

(i) at least one flotation cell having a cylindrical upper section;

(ii) at least one spray nozzle rotatably mounted above said flotation cell for rotation about a centrally disposed vertical axis; and (iii) at least one skimmer means rotatably mounted above said flotation cell for rotation about a centrally disposed vertical axis and adapted to skim froth from the surface of a liquid in said flotation cell, wherein said spray nozzle and said skimmer means are mounted, relative to each other, in a manner whereby said spray nozzle creates froth behind the rotational skimming direction of said skimmer means.

DETAILED DESCRIPTION OF THE INVENTION

The method and apparatus of the present invention are adapted to the separation of a wide variety of solid-fluid streams by a unique arrangement for the generation of a solids containing froth phase and removal thereof and is suitable for the separation of many types of particulate matter, such as for example identified hereinabove.

For convenience herein, the apparatus and method of the present invention are described with reference to a coal froth flotation and beneficiation operation and in particular to the beneficiation process disclosed in U.S. Pat. Nos. 4,304,573, 4,332,593 and 4,412,843, all of which are incorporated herein by reference.

Figure 1:
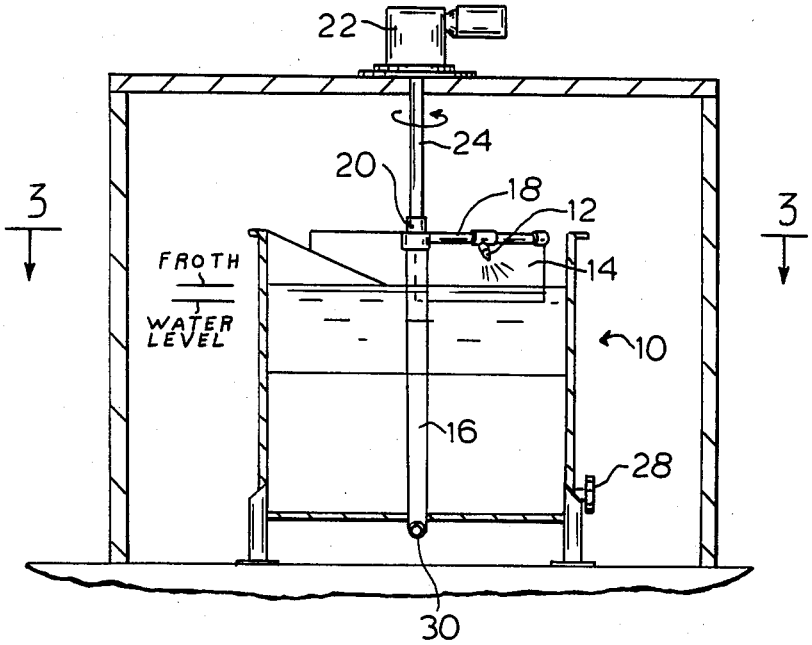
FIG. 1 is a schematic view of a cylindrical froth flotation cell according to the present invention.

Referring to the drawings herein in greater detail, FIG. 1 illustrates one embodiment of the present invention comprising a cylindrical flotation tank 10, a rotatably mounted spray nozzle 12 and rotatably mounted skimmer 14 positioned above the tank 10. In operation, an aqueous slurry of finely ground coal, associated impurities and if desired additional additives, such as chemical monomers, initiators, catalysts and fluid hydrocarbons (see for example, the afore-referenced U.S. Pat. Nos. 4,304,573, 4,332,593 and 4,412,843) is fed to the spray nozzle 12 at feed input 30 through centrally disposed conduit 16 and radially extending distribution manifold or arm 18 and sprayed from the spray nozzle 12 into the water in tank 10, thereby creating a froth on the water surface. Spray nozzle 12 and skimmer 14 are mounted on radially extending distribution manifold or arm 18 which is joined to centrally disposed conduit 16 by rotary union 20. As spray nozzle 12 discharges slurry, power drive unit 22, via rotating shaft 24, simultaneously rotates the spray nozzle 12 and skimmer 14 around the tank 10 and drives the skimmer 14 along the liquid surface in the tank 10 thereby skimming the froth in the direction opposite to the force of the slurry spray. The rotational speed of the spray nozzle and skimmer is not particularly critical to the process and is dependent upon the rate of feed input and amounts of material being processed. In one embodiment, a rotational speed of from about 5–8 r.p.m. is acceptable, for example. Thus, with the skimmer and spray nozzle arrangement of the present invention, the froth in front of the skimmer has sufficient time to dewater (drain) before it is scraped or skimmed from the cell. This increased residence time, results in less turbulence, improved froth generation and improved froth dewatering.

Figure 2:
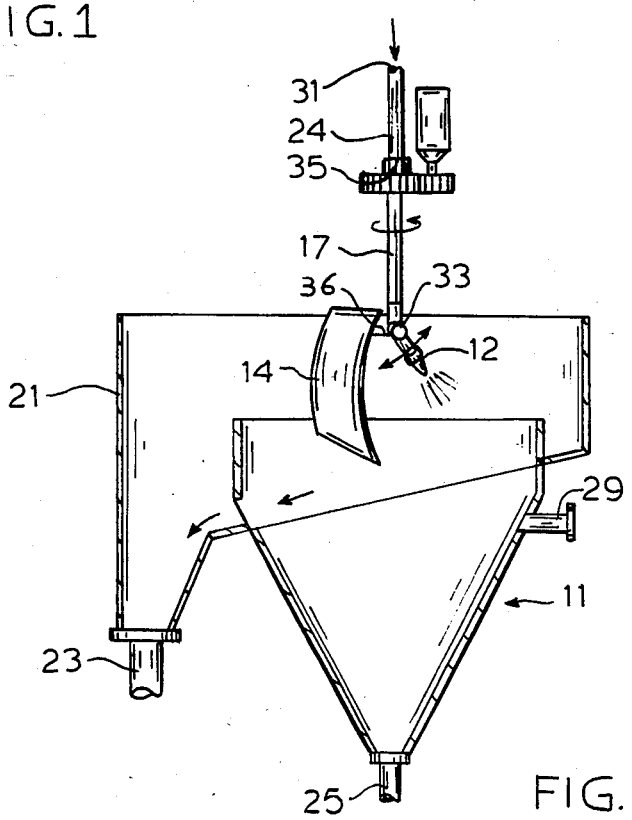
FIG. 2 is a side sectional view of a conical froth flotation tank according to the present invention.

FIG. 2 illustrates another embodiment of the present invention comprising a conically shaped flotation tank 11, a rotatably mounted spray nozzle 12 and rotatably mounted skimmer 14 positioned above the tank 11. In this arrangement, the aqueous slurry of finely ground coal, associated impurities and if desired additional additives, such as chemical monomers, initiators, catalysts and fluid hydrocarbons, is fed to the spray nozzle 12 at feed input 31 through stationary feed pipe 24 and centrally disposed conduit 17 and sprayed from the spray nozzle 12 into the water in tank 11. As with the embodiment shown in FIG. 1, spray nozzle 12 and skimmer 14 are mounted on a radially extending distribution manifold or arm 33. Feed pipe 24 is joined to centrally disposed conduit 17 by a rotary union 35. As spray nozzle 12 discharges slurry, power driven rotating conduit or shaft 17 simultaneously rotates the spray nozzle 12 and skimmer 14 around the cylindrical circular upper open end of the tank 11 and drives the skimmer 14 along the liquid surface (in the direction of the arrows) in tank 11 thereby skimming the froth in the direction opposite to the force of the slurry spray. The froth is skimmed by skimmer 14 into trough 21 and is recovered from outlet 23. Tailings exit the tank at outlet 25.

Figure 3:
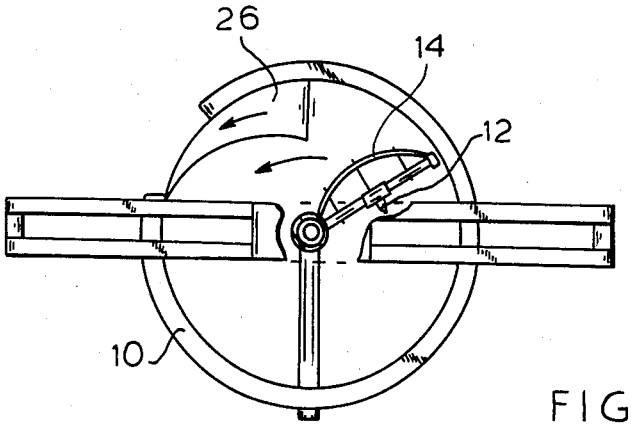
FIG. 3 is a top view of the froth flotation cell of FIG. 1 taken along line 3—3 of FIG. 1.
Figure 4:
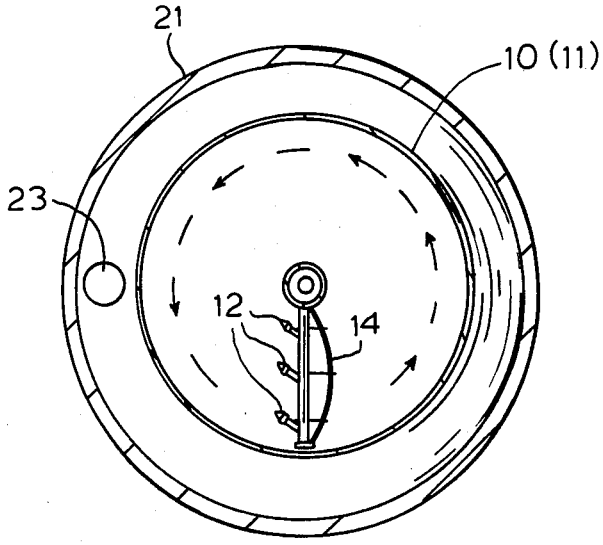
FIG. 4 is a top view of the froth flotation cells of FIGS. 1 or 2, however, illustrating the use of a plurality of spray nozzles and the rotational direction of the spray nozzles and skimming means around the cell.

FIGS. 3 and 4 are top views of the flotation cells 10 and 11 shown in FIGS. 1 and 2 and further illustrate the spray nozzle(s) and skimmer arrangement of the invention. FIG. 4 illustrates the use of a plurality of spray nozzles. In these embodiments, spray nozzle(s) 12 is (are) shown mounted above the cell 10 or 11 and behind the skimmer 14, i.e. behind the direction in which the skimmer scrapes the froth. The arrows indicate the direction in which the skimmer travels along the surface of the water in the cell 10 or 11 and also the direction in which the froth is removed from the cell. As is readily apparent from FIGS. 3 and 4, spray nozzle(s) 12 creates froth behind the skimmer 14 thus providing a time interval from when the froth is generated to when the froth is scraped from the cell. As such, the froth resides on the surface of water for a sufficient period to permit drainage before it is skimmed off and either collected or re-fed to another flotation cell for further treatment. Thus, in accordance with the arrangement of the present invention, one complete rotation of the skimmer and spray nozzle(s) accomplishes the actions of frothing, draining and skimming, and further provides a fresh liquid surface for the next-cycle of froth generation.

In a preferred embodiment of the present invention, skimmer means 14 is affixed to radially extending distribution manifold or arm 18 by means 36 which will permit adjustment in angle, height and side position of the skimmer with relation to liquid in the cell. Skimmer means 14 is preferably curved and formed of a flexible material such as a rubber. Further, spray nozzle 12 may also be adapted to allow for adjustment of the angle of inclination of the spray nozzle to the surface of the liquid in the cell.

Spray nozzle(s) 12 used in accordance with the present invention may be hollow jet nozzles which are commercially available and disclosed for example in U.S. Pat. No. 4,347,126 or U.S. Pat. No. 4,347,127, incorporated herein by reference. The nozzles are preferably constructed of stainless steel, other suitable hard metal or ceramic to avoid corrosion by the various particles in the slurry being pumped therethrough. The nozzles are preferably supplied with slurry in the supply manifolds at a pressure in the range of 5 to 40 psi, and more preferably in a pressure range of 15 to 20 psi. Particularly preferred spray nozzles for use herein are spiral, open flow type spray nozzles, for example, as disclosed in U.S. Pat. No. 4,514,291, incorporated herein by reference. These spiral, open flow type nozzles are also commercially available.

Thus, in accordance with the apparatus and method herein, a stream of coal slurry is pumped under pressure to spray nozzle 12 wherein the forces spray the coal slurry as fine droplets such that they are forcefully jetted into the mass of water in the tank 10 to form a froth. High shearing forces are created in nozzle 12 and the dispersed particles forcefully enter the surface of the water and break-up the coal-water flocs thereby water-wetting and releasing ash from the interstices between the coal flocs and breaking up the coal flocs so that the exposed ash surfaces introduced into the water are separated from the floating coal particles and sink into the water bath.

The surfaces of the finely divided coal particles now contain air sorbed in the atomized particles. The combined effects on the treated coal cause the flocculated coal to decrease in apparent density and to float or froth on the surface of the water in the tank. The hydrophilic ash remains in the bulk water phase and tends to settle downwardly in the tank. As illustrated in FIGS. 1 and 2, in one embodiment of the present invention, counterflow water may be introduced into the tank 10 or 11 at inlet 28 or 29 to provide a tangentially decreasing curve stream so that settling particles are kept moving to the bottom of the tank. The introduction of this counterflow water also maintains the desired water level in the tank.

In addition to all the afore-described advantages of the invention herein, the present froth flotation apparatus and method eliminate the necessity for separate agitation means in the cell and reduce the amount of energy required to drive the skimmer means since the force of the spray nozzle or nozzles situated behind the skimmer means partially drives the skimmer means. Furthermore, the apparatus and method herein provide a froth flotation operation which is more efficient, i.e. processes more coal or other solid matter in a shorter time and in less area, than previous processes and apparatus.

While the description hereinabove and the drawings herein relate to and illustrate one flotation cell, it is contemplated herein to employ a plurality of flotation cells in series each having the rotational spray nozzle and skimmer arrangement of the present invention. In this embodiment, after the coal, for example, has been floated in one cell it is introduced to a second or third cell, etc. for further flotation and beneficiation.

In order that those skilled in the art may better understand how the present invention may be practiced, the following examples are given by way of illustration and not by way of limitation.

EXAMPLE 1

Referring to FIG. 1, Wells blend coal, having the ash content identified in the Table below, is beneficiated by introducing aqueous particulate coal slurry which has been "reagentized" i.e. treated, with No. 2 fuel oil, 4.6 lb./ton, hydrogen peroxide, 0.87 lb./ton, butoxyethoxy propanol, 0.21 lb./ton, and cupric nitrate, 0.9 lb./ton, to spray nozzle 12 and sprayed in tank 10 which is filled with water. The reagentized particulate aqueous coal feed is fed to the spray nozzle 12 and tank 10 at a rate of 1400 lbs/hr. dry basis. The generated froth is skimmed from the surface of the water in tank 10 by the rotation of the skimmer blade as shown in FIG. 2. The rotational speed of the spray nozzle and skimmer blade is about 5–8 r.p.m. The froth is then collected and analyzed. The test results are shown in the Table below.

TABLE

| | coal (slurry) feed | | froth | | Tailing | | |
|---|---|---|---|---|---|---|---|
| Time Sample Taken | % Solids Concentration | % ash | % Solids Concentration | % ash | % Solids Concentration | % ash | (one-cell) RECOVERY |
| 2:00 p.m. | 10.24 | 4.96 | 20.85 | 3.62 | 1.13 | 9.91 | 79.8% |
| 2:30 p.m. | 13.88 | 5.18 | 19.97 | 3.96 | 1.40 | 10.70 | 83.0% |
| 3:00 p.m. | 14.17 | 5.67 | 21.08 | 3.81 | 1.35 | 11.23 | 76.0% |
| 3:30 p.m. | 14.25 | 5.54 | 19.76 | 3.71 | 1.39 | 10.96 | 76.0% |

Cell Dimension: 35 inches diameter × 35 inches height. (surface area: 6.68 sq. ft.) specific flotation rate: 210 lb/ft$^2$ hr.

While several embodiments and variations of a method and apparatus for froth flotation separation of the components of a slurry have been described in detail herein, it should be apparent that the teachings and disclosure herein will suggest many other embodiments and variations to those skilled in the art.

We claim:

1. Apparatus for froth flotation separation of the components of a slurry, said apparatus comprising:

(i) at least one froth flotation cell having a cylindrical upper section, overflow means and underflow means, said cell adapted to contain a liquid bath therein defining a liquid level in said cylindrical upper section;

(ii) at least one spray nozzle rotatably mounted above said liquid level in said flotation cell for rotation about a centrally disposed vertical axis of said cell;

(iii) means to rotate said at least one spray nozzle about said vertical axis in a given direciton;

(iv) means for introducing slurry containing particulate matter to said spray nozzle;

said means to rotate said at least one nozzle includes at least a portion of said means for introducing said slurry and (v) at least one skimmer means mounted to said means to rotate and positioned so as to skim froth from the surface of a liquid in said flotation cell toward said overflow means; said at least one spray nozzle and said skimmer means are mounted on said means to rotate relative to each other such that when said skimmer means and said at least one spray nozzle are rotated in said direction said at least one spray nozzle creates a froth behind said skimmer means in a direction opposite to said given direction.

2. The apparatus of claim 1 wherein said means to rotate comprises a radially extending arm joined to a centrally disposed vertical conduit means in said flotation tank.

3. The apparatus of claim 1 wherein said at least one spray nozzle comprises a plurality of spray nozzles mounted to said means to rotate.

4. The apparatus of claim 1 wherein said at least one spray nozzle is adapted with means to adjust the angle of inclination of said at least one spray nozzle to the surface of said liquid in said flotation cell.

5. The apparatus of claim 1 wherein said at least one spray nozzle is a spiral, open flow spray nozzle.

6. The apparatus of claim 1 wherein said means for introducing slurry comprises an inlet means provided at the bottom of said flotation cell.

7. The apparatus of claim 1 wherein said means for introducing slurry comprises an inlet means provided at the top of said flotation cell.

8. A method for froth flotation separation of the components of a slurry having particulate matter therein, said method comprising the steps of:

(i) introducing a slurry containing particulate matter to at least one spray nozzle mounted above the liquid level of a froth flotation cell;

(ii) circumferentially rotating said at least one spray nozzle in a given direction about a vertical axis defined by said cell;

(iii) spraying said slurry onto the surface of said liquid as said at least one nozzle is rotated thereby creating a froth on the surface of said liquid contained in said flotation cell; and (iv) skimming said froth created by said at least one rotating spray nozzle from said liquid surface by circumferentially rotating a skimmer means in said given direction ahead of said at least one rotating spray nozzle in said given direction, whereby there is provided a continual time interval between froth creation and froth skimming.

9. The method of claim 8 wherein said slurry is sprayed through a plurality of circumferentially rotating spray nozzles.

10. The method of claim 8 said slurry comprises an aqueous slurry of coal particles, whereby the method is utilized for the beneficiation of coal.

* * * * *